US005579715A

United States Patent [19]

Harrell

[11] Patent Number: 5,579,715

[45] Date of Patent: Dec. 3, 1996

[54] MINI SPRAY SKIRT

[76] Inventor: Freida Harrell, 3026 Tallavana Trail, Havana, Fla. 32333

[21] Appl. No.: 403,283

[22] Filed: Mar. 13, 1995

[51] Int. Cl.[6] ..... B63B 17/00

[52] U.S. Cl. ..... 114/361; 114/347

[58] Field of Search ..... 114/347, 361

[56] References Cited

U.S. PATENT DOCUMENTS 4,699,076 10/1987 Curtis et al. ..... 114/347
5,367,975 11/1994 Hamilton et al. ..... 114/347

FOREIGN PATENT DOCUMENTS 507952 9/1930 Germany ..... 114/347

*Primary Examiner*—Jesus D. Sotelo
*Attorney, Agent, or Firm*—Carnes, Cona, and Dixon

[57] ABSTRACT

The present invention provides for a spray skirt that is adapted to be removably secured to a front portion of a cockpit of a kayak. The spray skirt includes a base triangular in shape and has a front end and a back portion. The back portion includes two distal ends of the triangular shape base. A channel extends from one distal end of the base to the front end and from the front end to the second distal end. An elastic cord having a first end and a second extends through this channel and outwardly from the distal ends of the base. This will provide for the first end of the cord to extend from the first distal end of the base and the second end of the cord to extend from the second distal end of the base. The first and second ends are received within a securing mechanism. This will enable the base to fit on the front area of the cockpit by providing the channel and cord to fit underneath the rim of the cockpit. The excess cord is tightened around the rim of the cockpit and is locked into place by way of the securing mechanism, thereby securing the spray skirt in a fixed position onto the cockpit.

16 Claims, 4 Drawing Sheets

MINI SPRAY SKIRT

BACKGROUND OF THE INVENTION

1. Field of the Invention

The present invention relates generally to a spray skirt and more particularly to a self adjusting mini spray skirt that is used to cover the front portion of a cockpit opening of a kayak or the like.

2. Description of the Prior Art

Cockpit covers or spray skirts are commonly known and utilized. These devices provide for the kayak user to remain dry and warm when out in the water. Normally, a spray skirt will include a fitted waist portion and a lower portion. The fitted waist portion receives the user's waist to provide for a snug and comfortable fit. The outer edge of the lower portion engages the raised lip or rim of the cockpit opening, inherently covering the cockpit. An example of this type of spray skirt is illustrated and discussed in U.S. Pat. No. 5,367,975 issue to Hamilton et al.

A problem associated with this type of spray skirt is that they are heavy and form fitting. During the hot and humid summer months this heavy material in combination with the fitted waist portion, renders extremely high temperatures within the cockpit, making it virtually impossible to comfortably maneuver the kayak.

Another problem associated with this design of the spray skirt is the limited access to the cockpit when the spray skirt is secured on the kayak. Since prior art designs provide for a snug fit along the waist of the user, it is infeasible to reach inside the cockpit in order to obtain items, such as a water bottle, bug repellent or the like, from the cockpit of the kayak.

What is needed is a spray skirt for a kayak that is easy to use, provides air circulation and access to the cockpit, and is also light weight, washable, and enables safe exit and escapability during flipping or under water pinning of the kayak.

None of these previous efforts, however, provide the benefits intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides a spray skirt or spray cockpit cover that is adapted to be removably secured to the front rim portion of the cockpit of a kayak.

This spray skirt or spray cockpit cover consists of a somewhat triangular shape base. This will provide for a front end and a back portion which includes two distal ends of the triangular shape base. The periphery of the base except for the edge located between the distal ends, is folded under and secured to back of the base to provide for an opening or channel to exists partially around the perimeter of the base. Hence, the channel extends from the first distal end to the front end and from the front end to the second distal end. A bungee cord or the like is inserted into this channel. This bungee cord or the like extends through the channel and the excess bungee cord or the like extends outwardly from the distal ends of the base. Thereby permitting the bungee cord or the like to fit completely around the rim of the cockpit. This enables the base to fit on the front area of cockpit by providing the channel and bungee cord or the like to fit underneath the rim of the cockpit. The excess bungee cord or the like then extends under the rim of the back portion of the cockpit. The bungee cord is tighten around the rim of the cockpit and locked in place by way of a securing means thereby securing the skirt in a fixed position over the cockpit.

The spray skirt also includes a drip bar, which is located in the proximity of the distal ends of the base. This drip bar aids in the prevention of water splashing on the user. Additionally, this drip bar also guides water off the kayak when the kayak is utilized.

Accordingly, it is the object of the present invention to provide for a spray skirt that is non-conforming, provide air circulation and access to the cockpit, as well as being light weight, washable, and enable safe exit and escapability during flipping or under water pinning of the kayak.

It is another object of the present invention to provide for a spray skirt that partially covers a portion of the cockpit in order to provide coverage in the front of the cockpit.

Another object of the present invention provides for a spray skirt cover that includes a drip bar that will aid in the prevention of the water into the cockpit.

A final object of the present invention, to be specifically enumerated herein, is to provide a spray skirt device in accordance with the preceding objects and which will conform to conventional forms of manufacture, be of simple construction and easy to use so as to provide a device that would be economically feasible, long lasting and relatively trouble free in operation.

Although there have been many inventions related to a spray skirt devices, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1:
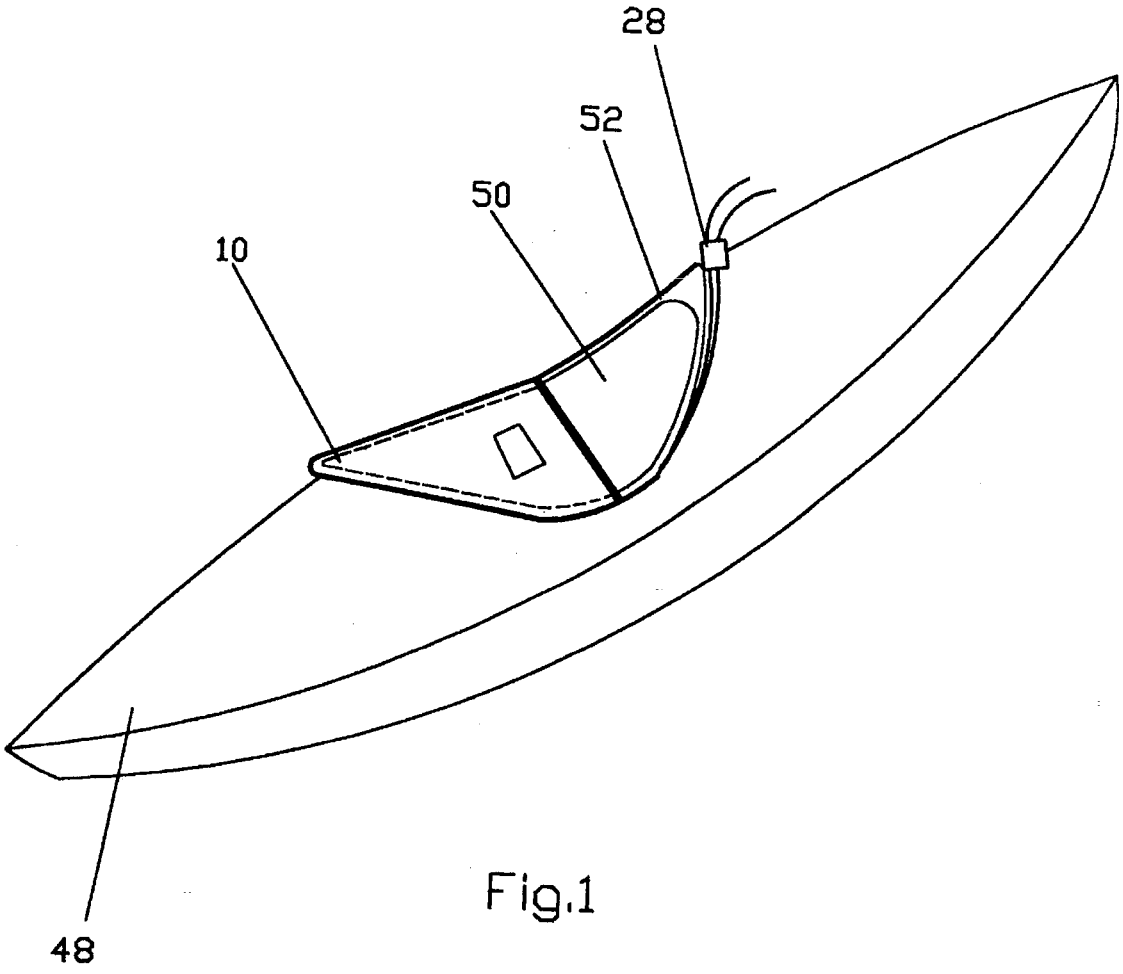
FIG. 1 is a perspective view spray skirt of the present invention installed on a kayak.

FIGS. 1–5 illustrate the various view of the present invention. The spray skirt 10 is designed and configured to fit on the front portion of the cockpit 50 of the kayak 48. As seen in these figures, the spray skirt 10 of the present invention includes a base 12. This base 12 has a somewhat triangular shape and includes a front end 14 and a back portion 16. The front end 14, as illustrated, is curved. This back portion 16 includes distal ends 18 and 20. This somewhat triangular shape provides for a first edge to exist between the first distal end 18 and the curved front end 14, a second edge exists between the second distal end 20 and the curved front end 14, and a third edge exists between the first distal end 18 and the second distal end 20. The first, second, and third edges are illustrated but are not labeled.

A portion of the periphery of the base 12 is folded under and secured to the under surface 22 of the base 12. This portion includes all but the third edge, between the distal ends 18 and 20 of the base. The securement can be accomplished by any conventional means such as the use of an adhesive or sewing. This folded periphery provides for a channel 24 to exist along the first and second edges and the front end of the base 12, accordingly, leaving the third edge, located between the distal ends 18 and 20 free from a channel. This channel 24 is illustrated in outline in FIGS. 1 and 2 and clearly seen in the cross sectional view in FIG. 4.

The channel 24 receives an elastic like cord 26, such as a bungee cord. The first end 34 of the cord 26 is inserted into the channel 24 at the second distal end 20. This cord travels through the entire length of the channel 24 and exits at the first distal end 18 of the base. This will provide for the second end 36 of the elastic like cord 26 to extend outwardly from the second distal end 20 of the base and for the first end 34 of the elastic like cord 26 to extend outwardly from the first distal end 20 of the base (see FIG. 2). This design and configuration of the channel 24 and elastic like cord 26 of spray skirt 10 provides for the elastic like cord to fit snugly around and under the rim 52 of the kayak, inherently causing the spray skirt to also fit snugly around the front of the cockpit of a kayak. The elastic like cord 26 is tightened and held in a fixed position via a securing means 28.

Figure 6:
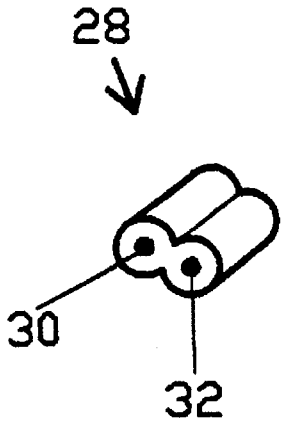
FIG. 6 is a perspective view of the securing means used for the spray skirt of the present invention.

The securing means 28 (see FIG. 6) consists of a tube that includes two hollow channels 30 and 32. The securing means is made from a rigid and water proof material, such as polyvinyl chloride (PVC) or any plastic material. These channels receive the ends 34 and 36 of the elastic like cord. The pulling of the securing means inherently causes the elastic like cord to stretch and decrease in diameter. This will permit for the securing means to slide freely on the cord. Once a desired location is reach, the securing means is released and the elastic-like cord returns to its normal diameter. Once at its normal diameter, the elastic like cord is secured in a fixed position.

It is noted, however, that the securing means can be altered to provide for only one hollow channel to exists. This will enable both ends 34 and 36 of the elastic like cord to be received by the one hollow channel. This alteration of the securing means will provide for the device to function and operate in the same manner as with the securing means having two channels.

A drip bar 38 is located near the back of the top surface of the base. This drip bar 38 extends upwardly from the base and aids in the prevention of water entering into the cockpit. The drip bar 38, illustrated in a cross sectional view in FIG. 5, consists of an inner core 40. This inner cord 40 is fabricated from a rigid and water proof material, similar to the material of the securing means. An outer layer 42 surrounds the inner core. This outer material is made from a flexible, water proof material, such as nylon that has been treated or coated with for a water proofing substance, Gore-Tex, or neoprene.

It is noted that the figures illustrate that the drip bar has a circular cross section, however the drip bar can encompass any shape or design. The shape and design of the drip bar is such that it must extend upwardly from the top surface of the base in order prevent water from entering into the cockpit of the kayak.

Figure 2:
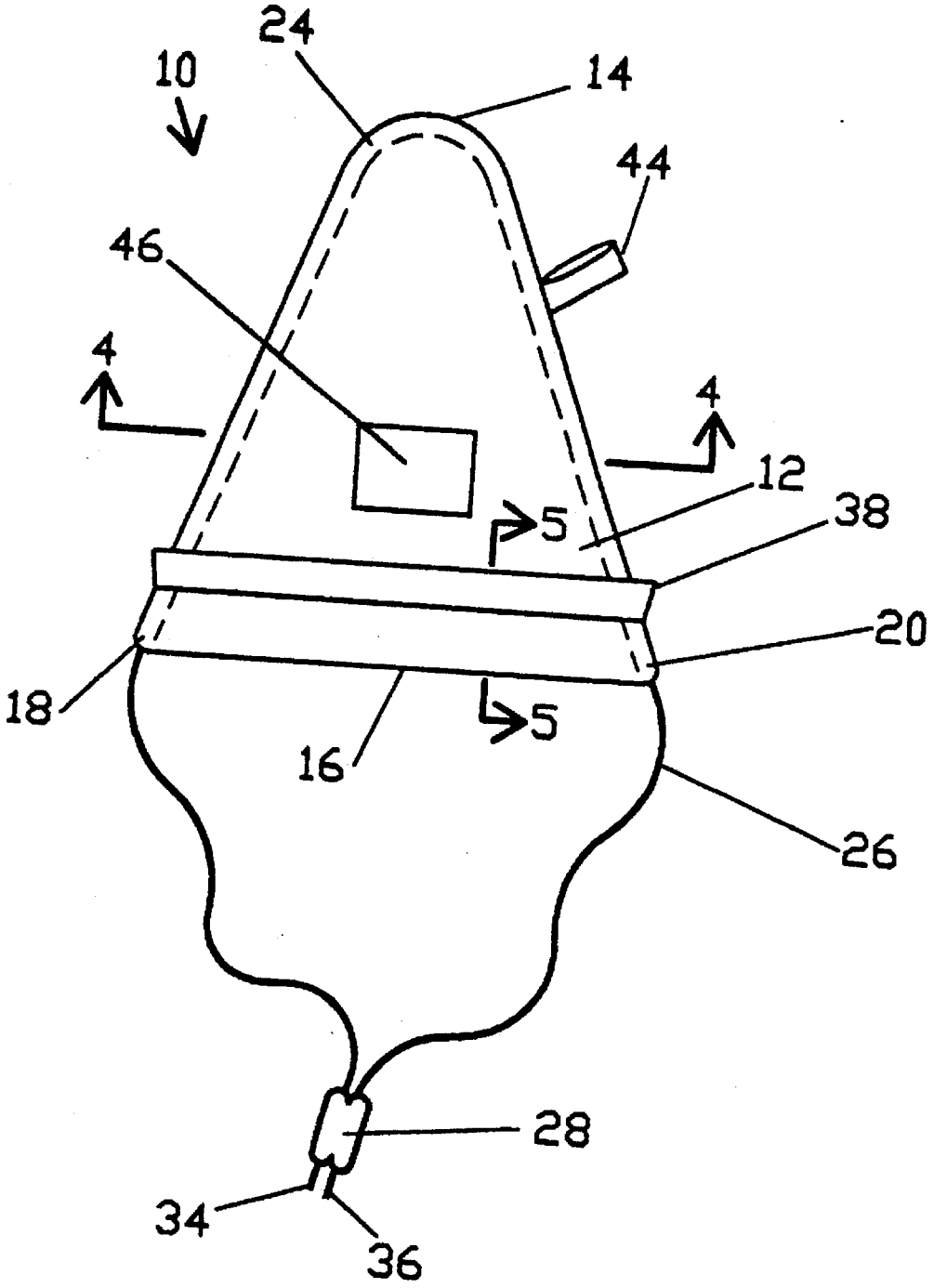
FIG. 2 is a top view of the spray skirt of the present invention.
Figure 3:
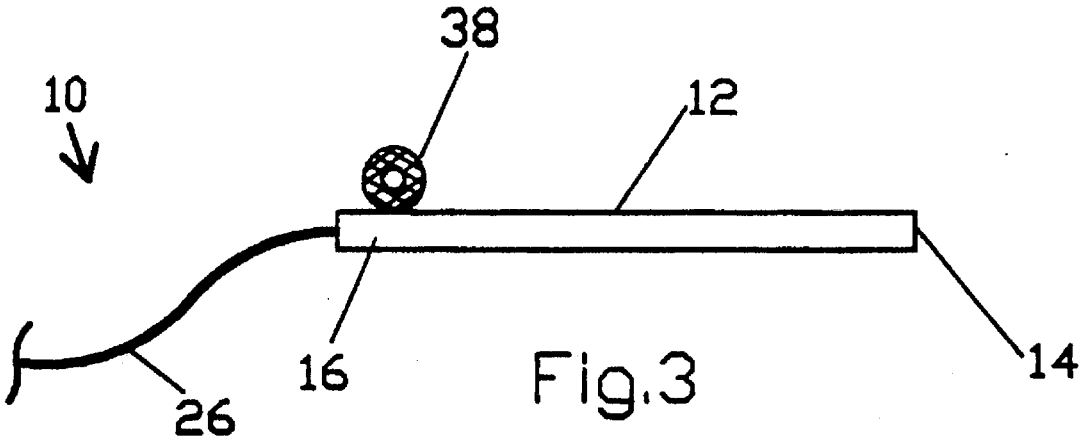
FIG. 3 is a side view of the spray skirt of the present invention.
Figure 4:
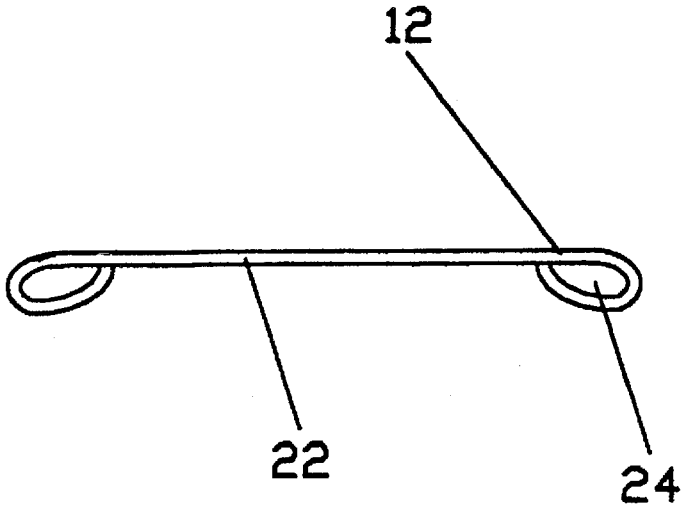
FIG. 4 is cross sectional view of the spray skirt of the present invention taken along lines 4—4 of FIG. 2.
Figure 5:
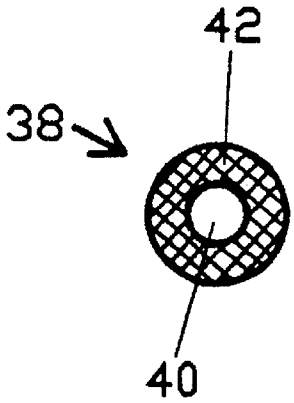
FIG. 5 is a cross sectional view of the drip bar of the present invention taken along lines 5—5 of FIG. 2.

For easy removal of the spray skirt 10, a quick release 44 is attached to its first or second edge in the proximity of the front end 14. This quick release 44 will permit for the user to quickly and efficiently pull on this release for enabling the elastic cord to expand and disengage from the rim 50 of the cockpit 50. FIG. 2 illustrates the quick release 44 to be a loop of material. Thereby, this will permit for the user to grasp and pull on the loop of material in order to disengage the spray skirt from the rim of the kayak.

Attachments and accessories may be attached to the surfaces of the base 12. One such accessory is a pocket 46. This pocket can be located on the outer surface of the spray skirt 10. The pocket can be fabricated from a water proof or net (mesh) like material.

The base of the spray skirt of the present invention can be fabricated from any light weight, water proof material, such as treated nylon, Gore-Tex, neoprene, or the like.

While the invention has been particularly shown and described with reference to an embodiment thereof, it will be understood by those skilled in the art that various changes in form and detail may be made without departing from the spirit and scope of the invention.

I claim:

1. A spray skirt to be used in combination with a kayak having a cockpit with a rim comprising:

a substantially flexible base;

said base is removably secured to said rim of said cockpit via an attaching means and said base partially covers said cockpit by covering only a front portion of said cockpit;

said base has a somewhat triangular shape having a curved front end and a back portion;

said back portion includes a first distal end and a second distal end having an edge located between said first distal end and said second distal end; and said edge is straight for providing said edge to be centrally located on said cockpit when said spray skit is secured to said rim and extend horizontally across said cockpit.

2. A spray skirt in combination with a kayak as in claim 1 wherein said attaching means includes a channel, an elastic like cord, and a securing means, said channel is located on a periphery of said base extending from said first distal end to said curved front end and from said curved front end to said second distal end of said base, and said elastic like cord extends through said channel and a securing means receives said elastic like cord, said attaching means enables said channel and said elastic like cord to engage around said rim of said front portion of said cockpit and said elastic like cord to extend around and under said rim of a back portion of said cockpit and to permit said securing means to affix said elastic like cord in a secured and snug position under said rim of said cockpit.

3. A spray skirt in combination with a kayak as in claim 2 wherein said securing means is a hollow tube having a diameter smaller than said elastic like cord and said hollow tube receives a first end and a second end of said elastic like cord for permitting pulling of said hollow tube to inherently cause said elastic like cord to stretch and decrease in size inherently providing said tube to slide freely on said elastic like cord and releasing said hollow tube provides for said elastic-like cord return to an original size and provides for said hollow tube to be secured in a fixed position.

4. A spray skirt in combination with a kayak as in claim 3 wherein a quick-release mechanism is attached to said base.

5. A spray skirt in combination with a kayak as in claim 1 wherein said base is fabricated from a waterproof material.

6. A spray skirt in combination with a kayak as in claim 1 wherein said base further includes a drip bar to be located in the proximity of said back portion, and said drip bar extends upwardly from said base.

7. A spray skirt in combination with a kayak as in claim 6 wherein a quick release mechanism is attached to said base.

8. A spray skirt in combination with a kayak as in claim 6 wherein said base further includes an outer surface and a pocket is attached to said outer surface.

9. A spray skirt to be used in combination with a kayak having a cockpit with a rim comprising:

a substantially flexible base;

said base is removably secured to said rim of said cockpit via an attaching means and said base partially covers said cockpit by covering only a front portion of said cockpit; and said base further includes a front end and a back portion, said back portion is adapted to be centrally located on said cockpit when said spray skirt is affixed to said rim and a drip bar is located in proximity to said back portion of said base and said drip bar extends upwardly from said base.

10. A spray skirt in combination with a kayak as in claim 9 wherein said drip bar includes a core made from a rigid material and an outer layer made from a water proof material.

11. A spray skirt in combination with a kayak as in claim 10 wherein a quick-release mechanism is attached to said base.

12. A spray skirt in combination with a kayak as in claim 9 wherein said base has a somewhat triangular shape and said front end is curved, said back portion includes a first distal end and a second distal end, an edge is located between said first distal end and said second distal end for providing said edge to be centrally located on said cockpit when said spray skirt is secured to said rim.

13. A spray skirt in combination with a kayak as in claim 12 wherein said attaching means includes a channel, an elastic like cord, and a securing means, said channel is located on a periphery of said base extending from said first distal end to said front end and from said front end to said second distal end of said base, and said elastic like cord extends through said channel and a securing means receives said elastic like cord, said attaching means enables said channel and said elastic like cord to engage around said rim of said front portion of said cockpit and said elastic like cord extends around and under said rim of a back portion of said cockpit and to permit said securing means to affix said elastic like cord in a secure and snug position under said rim of said cockpit.

14. A spray skirt to be used in combination with a kayak having a cockpit with a rim comprising:

a substantially flexible base;

said base is removably secured to said rim of said cockpit via an attaching means and said base partially covers said cockpit by covering only a front portion of said cockpit; and said base further includes an outer surface and a pocket is attached to said outer surface.

15. A spray skirt in combination with a kayak as in claim 14 wherein said base further includes a front end and a back portion, said back end includes a first distal end and a second distal end and said front end is curved, a first edge is located between said first distal end and said front end, a second edge is located between said second distal end and said front end, and a third edge is located between said first distal end and said second distal end, and said first edge, said second edge, and said front end of said base is removably secured to said rim of said cockpit via an attaching means and said base, when secured to said rim, covers only a front portion of said cockpit.

16. A spray skirt in combination with a kayak as in claim 15 wherein said attaching means includes a channel, an elastic like cord, and a securing means, said channel is located on the periphery of said first edge, said front end, and said second edge of said base, and said elastic like cord extends through said channel, and a securing means receives said elastic like cord, said attaching means enable said first edge, said front end, and said second edge to engage around said rim of said front portion of said cockpit and said elastic like cord is adapted to extend around and under said rim of a back portion of said cockpit and to permit said securing means to affix said elastic like cord in a secure and snug position under said rim of said cockpit.

* * * * *